US008840074B1

(12) United States Patent
Bunch

(10) Patent No.: US 8,840,074 B1
(45) Date of Patent: Sep. 23, 2014

(54) LOAD BEARING STRUCTURE

(71) Applicant: Michael Bunch, Houston, TX (US)

(72) Inventor: Michael Bunch, Houston, TX (US)

( * ) Notice: Subject to any disclaimer, the term of this patent is extended or adjusted under 35 U.S.C. 154(b) by 161 days.

(21) Appl. No.: 13/623,066

(22) Filed: Sep. 19, 2012

Related U.S. Application Data

(60) Provisional application No. 61/537,187, filed on Sep. 21, 2011.

(51) Int. Cl.
*F16M 13/00* (2006.01)

(52) U.S. Cl.
USPC ..... 248/158; 248/160; 52/643; 52/652.1; 52/653.1; 52/653.2

(58) Field of Classification Search
USPC ..... 248/158, 160, 161; 52/697, 652.1, 52/653.1, 653.2, 643, 649.5
See application file for complete search history.

(56) References Cited

U.S. PATENT DOCUMENTS 3,221,464 A * 12/1965 Miller ..... 52/651.09
3,836,979 A * 9/1974 Kurland et al. ..... 343/881
4,557,097 A * 12/1985 Mikulas et al. ..... 52/646
4,829,739 A * 5/1989 Coppa ..... 52/745.2
5,909,197 A * 6/1999 Heinemann et al. ..... 343/895
7,155,872 B2 * 1/2007 Francom ..... 52/648.1
2004/0107669 A1 * 6/2004 Francom ..... 52/697
2005/0115186 A1 * 6/2005 Jensen et al. ..... 52/633
2013/0292526 A1 * 11/2013 Murphy ..... 248/157

* cited by examiner

*Primary Examiner* — Amy J Sterling

(74) *Attorney, Agent, or Firm* — Plager Schack LLP

(57) ABSTRACT

An improved load bearing structure comprises a center pole is mechanically coupled to an outer helical rod by a plurality of cross helical support rods. The outer helical rod is mechanically coupled to an inner bracing triangle. The center pole, an inner helical rod and the outer helical rod are mechanically coupled to outer end bracing cross support rods and. The outer end bracing cross support rods are mechanically coupled to outer end bracing triangles. These triangles can have vertices bifurcated with lines to which the inner helical rod and the outer helical rod are attached in order to give the improved load bearing structure a shape of a helix based on Koch Snowflake with golden mean scaling such that the improved load bearing structure is substantially stronger than structures made of material of similar type and quantity.

3 Claims, 4 Drawing Sheets

LOAD BEARING STRUCTURE

CROSS REFERENCE TO RELATED APPLICATIONS

This application claims priority to U.S. Provisional Application 61/537,187 filed on Sep. 21, 2011.

FIELD OF THE INVENTION

This invention relates techniques for building structures of increased strength which are less prone to failure.

BACKGROUND OF THE INVENTION

This invention relates to the strength of materials as affected by the shape of the material. As a load is placed upon an object the object deforms based on 1) the material from which the object is made 2) the manner in which the material is made or treated and 3) the shape of the material. Where a three dimensional object is subjected to there can be at least three kinds of stresses: shear stress, bending stress and torsion stress. The manner in which static two-dimensional cross sections is well known. See generally Leckie, Strength and Stiffness of Engineering Systems (2009). Some recent research has begun on the effect of three dimensional loads on three dimensional structures.

In general the effect of the shape on the structure's strength is:

$$S_f = 6\frac{V^{\frac{2}{3}}}{S} \quad \text{[eqn. 1]}$$

So, the conventional thinking is that a greater volume and a smaller surface make a shape less resilient to shear bending and torsion. The present invention explains that certain geometric ratios are better for making members resilient to stress, strain and torsion and conventional shapes and can have better performance than a material of similar type and quantity.

BRIEF SUMMARY OF THE INVENTION

An improved load bearing structure comprises a center pole is mechanically coupled to an outer helical rod by a plurality of cross helical support rods. The outer helical rod is mechanically coupled to an inner bracing triangle. The center pole, an inner helical rod and the outer helical rod are mechanically coupled to outer end bracing cross support rods and. The outer end bracing cross support rods are mechanically coupled to outer end bracing triangles. These triangles can have vertices bifurcated with lines to which the inner helical rod and the outer helical rod are attached in order to give the improved load bearing structure a shape of a helix based on Koch Snowflake with golden mean scaling such that the improved load bearing structure is substantially stronger than structures made of material of similar type and quantity.

BRIEF DESCRIPTION OF THE SEVERAL VIEWS OF THE DRAWINGS

Figures 1, 2, 3, 4, 5:
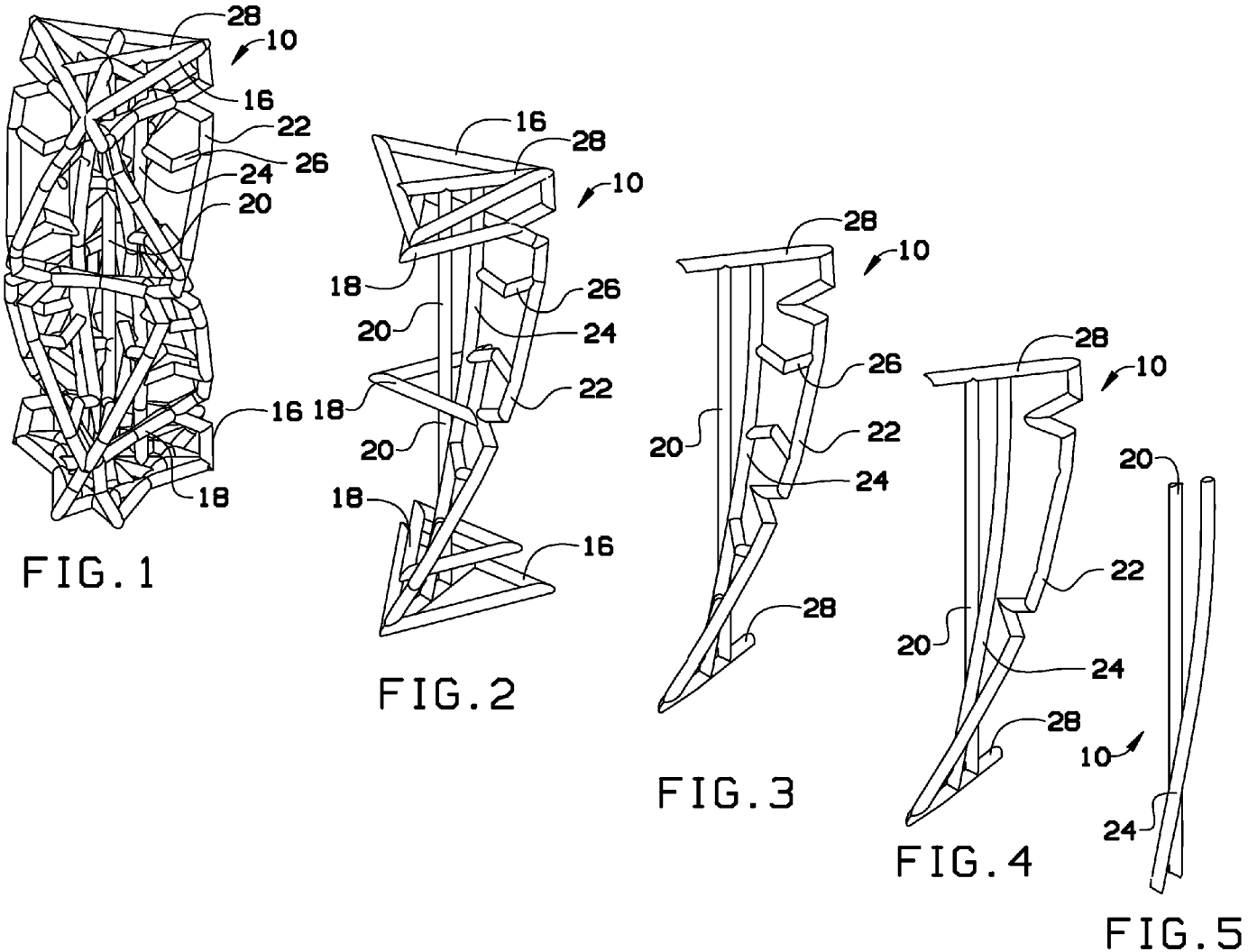

Having thus described the invention in general terms, reference will now be made to the accompanying drawings, which are not necessarily drawn to scale, and wherein:

FIG. 1 is a perspective detail view of a column in full configuration.

FIG. 2 is a perspective detail view of a column in full configuration.

FIG. 3 is a perspective detail view of a column in full configuration.

FIG. 4 is a perspective detail view of a column in full configuration.

FIG. 5 is a perspective detail view of a column in full configuration.

Figures 6, 7, 8, 9:
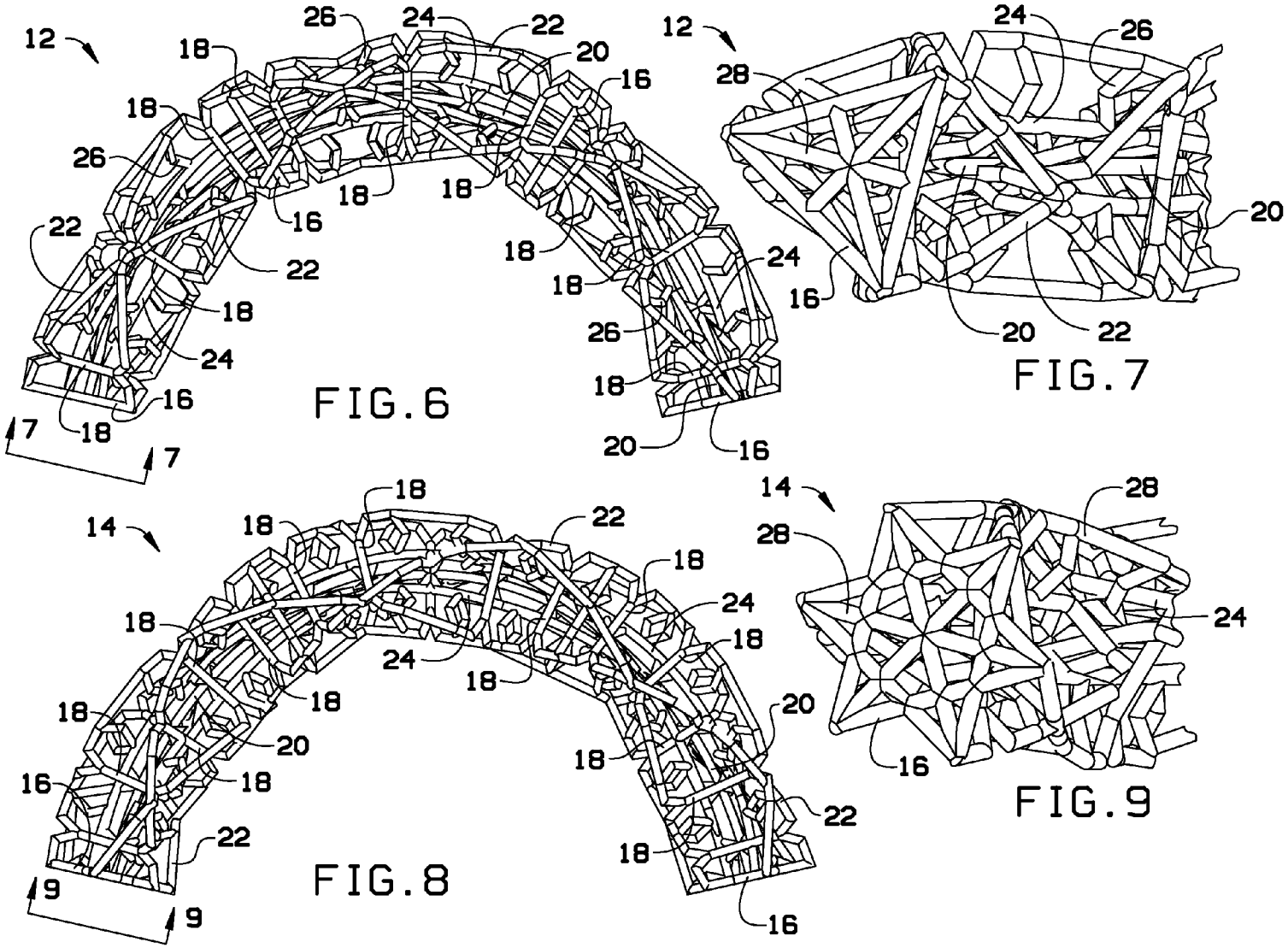

FIG. 6 is a front view of a first arch type.

FIG. 7 is a bottom detail view of a first arch type.

FIG. 8 is a front view of a second arch type.

FIG. 9 is a bottom detail view of the second arch type.

Figure 10:
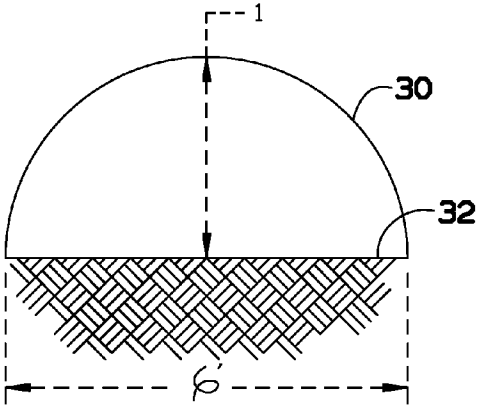

FIG. 10 is an arch schematic view of the invention.

Figure 11:
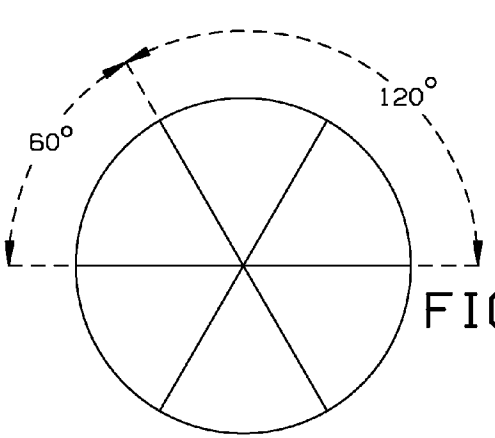

FIG. 11 is a schematic view of the invention.

Figure 12:
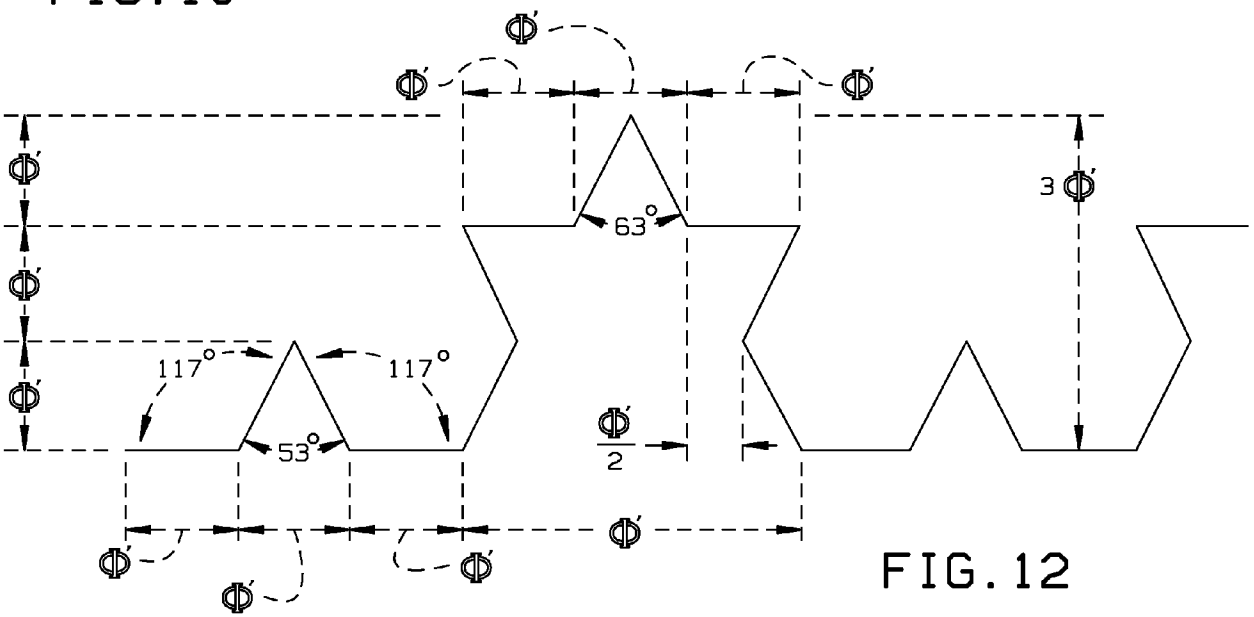

FIG. 12 is a golden star element schematic view of the invention.

Figure 13:
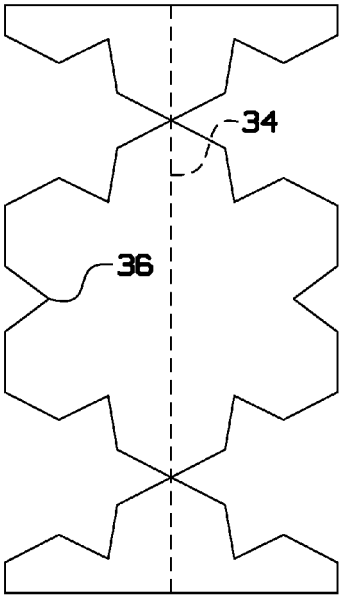

FIG. 13 is an elevation column schematic view of the invention.

Figure 14:
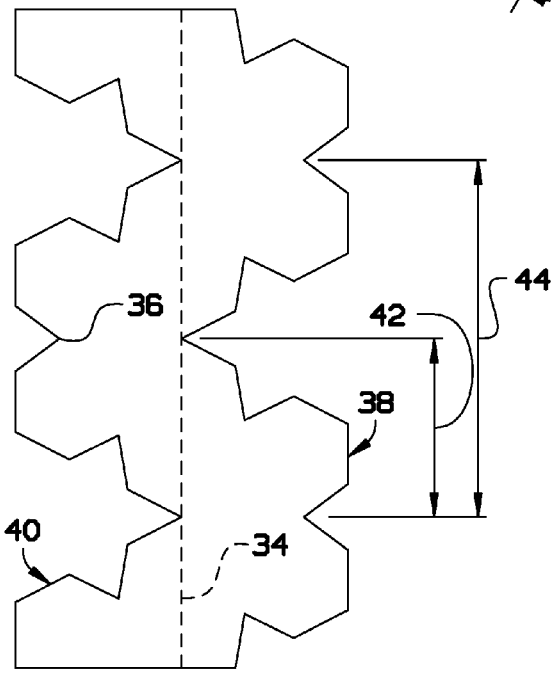

FIG. 14 is an elevation column schematic view of the invention.

Figure 15:
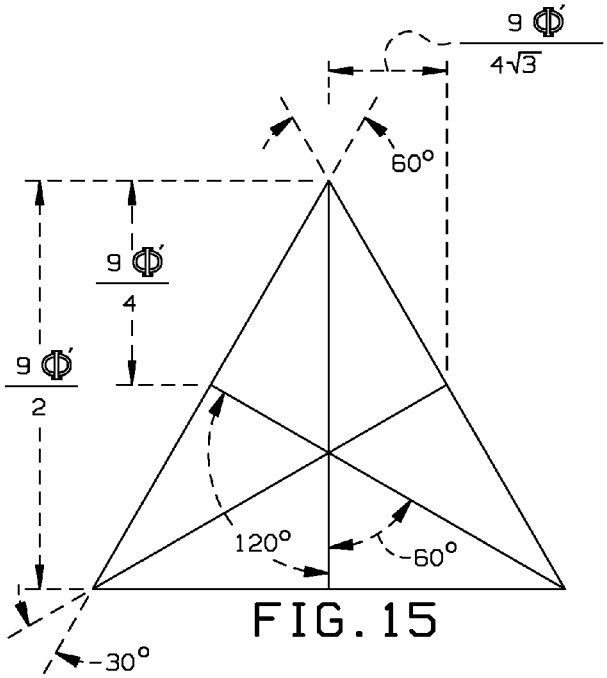

FIG. 15 is an outer end bracing schematic view of the invention.

Figure 16:
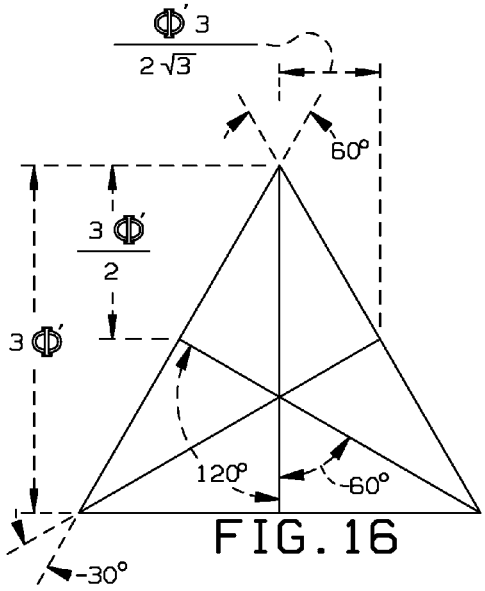

FIG. 16 is an inner end bracing schematic view of the invention.

DETAILED DESCRIPTION OF THE INVENTION

Embodiments of the present invention overcome many of the obstacles associated with increasing strength of members in structures, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Column 10 is built by overlapping three geometric relationships: the Koch star (or Koch snowflake); the golden mean and a rotation of 137.5 degrees.

The Koch star can be constructed by starting with an equilateral triangle, then recursively altering each line segment as follows: first, divide the line segment into three segments of equal length. Next, draw an equilateral triangle that has the middle segment from step 1 as its base and points outward. Finally, remove the line segment that is the base of the triangle from step 2. This can be repeated an unlimited number of times. The Koch snowflake as used in the present invention need not be precise and a profile that deviates up to 50% from expected values can still function. The Koch snowflake with a tolerance of 50% is called the prime Koch snowflake in the present invention.

The golden mean is a well-known geometric ratio commonly represented by the lowercase Greek letter phi ($\phi$).

$$\varphi = \frac{1+\sqrt{5}}{2} \quad \text{[eqn. 1]}$$

However precision is not required for the invention to function, accordingly a range of permissible values is:

$$\frac{1+\sqrt{5}}{4} \le \varphi' \le \frac{3(1+\sqrt{5})}{2} \quad \text{[eqn. 2]}$$

Likewise, the golden ratio conjugate is well known and is represented by the capital Greek letter phi (Φ).

$$\Phi = \frac{1}{\varphi} \quad \text{[eqn. 3]}$$

However precision is not required for the invention to function, accordingly a range of permissible values is:

$$\frac{1}{2\varphi} \le \Phi' \le \frac{3}{2\varphi} \quad \text{[eqn. 4]}$$

The rotation of 137.5 degrees is ideal, but it need not be precise. A range of permissible values is defined using the Greek letter theta (θ):

$$47.5° \le \theta \le 227.5° \quad \text{[eqn. 5]}$$

FIG. 1, FIG. 2, FIG. 3, FIG. 4 and FIG. 5 show the invention in assembly. Column 10 comprises center pole 20, where center pole 20 further comprises a center pole top and a center pole bottom. Center pole 20 is proximate inner helical rod 24 and outer helical rod 22. Inner helical rod 24 further comprises an inner helical rod top and an inner helical rod bottom. Likewise, outer helical rod 22 further comprises an outer helical rod top and an outer helical rod bottom.

The center pole top, inner helical rod top and outer helical rod top are mechanically coupled to upper outer end bracing cross support rod 28. Upper outer end bracing cross support rod 28 is mechanically coupled to upper outer end bracing triangle 16. In a similar manner, the center pole bottom, inner helical rod bottom and outer helical rod bottom are mechanically coupled to lower outer end bracing cross support rod 28. Lower outer end bracing cross support rod 28 is mechanically coupled to lower outer end bracing triangle 16.

Center pole 20 is mechanically coupled to outer helical rod 22 by a plurality of cross helical support rods 26. Outer helical rod 22 is also mechanically coupled to inner bracing triangle 18.

FIG. 6 and FIG. 7 show a second embodiment of the improved load bearing structure—first arch type 12. Like column 10, first arch type 12 comprises first arch type top and first arch type bottom (shown in FIG. 7). First arch type 12 comprises center pole 20 proximate inner helical rod 24 and outer helical rod 22. Inner helical rod 24 further comprises an inner helical rod top and an inner helical rod bottom. Likewise, outer helical rod 22 further comprises an outer helical rod top and an outer helical rod bottom. Center pole 20 is mechanically coupled to outer helical rod 22 by a plurality of cross helical support rods 26. Outer helical rod 22 is also mechanically coupled to inner bracing triangle 18. Center pole 20, inner helical rod 22 and outer helical rod 24 are mechanically coupled to upper outer end bracing cross support rod 28 and lower outer end bracing cross support rod 28. Upper outer end bracing cross support rod 28 is mechanically coupled to upper outer end bracing triangle 16. Lower outer end bracing cross support rod 28 is mechanically coupled to lower outer end bracing triangle 16.

FIG. 8 and FIG. 9 show a third embodiment of the improved load bearing structure—second arch type 14. Like column 10 and first arch type 12, second arch type 14 comprises first arch type top and first arch type bottom (shown in FIG. 9). Second arch type 14 comprises center pole 20 proximate inner helical rod 24 and outer helical rod 22. Inner helical rod 24 further comprises an inner helical rod top and an inner helical rod bottom. Likewise, outer helical rod 22 further comprises an outer helical rod top and an outer helical rod bottom. Center pole 20 is mechanically coupled to outer helical rod 22 by a plurality of cross helical support rods 26. Outer helical rod 22 is also mechanically coupled to inner bracing triangle 18. Center pole 20, inner helical rod 22 and outer helical rod 24 are mechanically coupled to upper outer end bracing cross support rod 28 and lower outer end bracing cross support rod 28. Upper outer end bracing cross support rod 28 is mechanically coupled to upper outer end bracing triangle 16. Lower outer end bracing cross support rod 28 is mechanically coupled to lower outer end bracing triangle 16.

Column 10, first arch type 12 and second arch 14 are made in a substantially similar manner. In any construction there is a first outer end bracing triangle 16 on a first end and a second outer bracing triangle 16 on the second end. A user can use as many inner bracing triangles 14 as desired such that the profile of the structure meets the specifications of FIG. 10 (for an arch), FIG. 12 and FIG. 13. In this manner each profile has a center line as noted below and each center pole 20 proximate inner helical rod 24 and outer helical rod 22 rotate θ' from the location on first outer end bracing triangle 16 on a first end and a second outer bracing triangle 16 on the second end.

In the preferred embodiment, column 10, first arch type 12 and second arch 14 are intended to be computer printed with computer manufacturing machines. Alternately, column 10, first arch type 12 and second arch 14 can be spun in one piece from carbon fiber or Nano tubes continuous in total or built by computer aided CNC machines, automatic bending equipment and automatic welding. If a metal worker is to assemble column 10, first arch type 12 and second arch 14, one should computer measure the components and cut them assembled in a jig as already described and full welded all around.

In another embodiment a foreman can order the parts precut at the factory by laser computer equipment to the correct portions, angles of the cuts at the elliptical joints and overall lengths. A jig is to be constructed by a computer controlled CNC and bending equipment to conform to the manufacturing requirements and the specifications. The pieces are to be placed in a jig to conform to the correct curve, proportion and part location then full welded all around at all joints.

Preliminary testing indicates 3,000 psi mild steel rebar rod arranged in this manner can support a 7,953 psi compressive load capacity.

FIG. 10 shows the arrangement of first arch type 12 or second arch type 14 in more detail. The relationship between the height of centerline 30 of first arch type 12 or second arch type 14 along ground line 32 is 1:φ'.

FIG. 11 shows the rotation of components about a centerline. Each component is rotated θ'.

FIG. 13 shows the dimensions of a Koch Snowflake when arranged with the golden mean to form a portion of right hand helix 38. From left to right, a first segment has length Φ' when it creates a first triangle with both length and height of Φ'. A second segment has Φ' which it enters the star. The star has a first star segment of length Φ', height Φ' and width Φ'/2 traveling away from the first triangle and attached to a second star segment. The second star segment has length Φ', height Φ' and width Φ'/2 traveling toward from the first triangle and attached to a third star segment. The third star segment is parallel to the first segment, has a length Φ' and is attached to a star triangle. The star triangle is similar in size and direction to the first triangle and is attached to a fourth star segment. The fourth star segment is a mirror image reflection of the third star segment and is attached to a fifth star segment. The fifth star segment is a mirror image reflection of the second star segment and is attached to a sixth star segment. The sixth star segment is a mirror image reflection of the first star segment and is attached to a third segment. The third segment begins this pattern again. The star has a height of 3 Φ'. Of course, left hand helix 40, could be created by using a simply sliding the pattern half module 42.

FIG. 13 shows one manner of using counter clockwise helix strand 36 by using one such helix strand on each side of centerline 34 creating a pattern that mimics the Koch Snowflake with golden mean scaling. The pattern starts with outer end bracing triangle 16 on the bottom and center pol 20, outer helical rod 22 and inner helical rod 24 extending upward, rotated 137.5 degrees and bent, as necessary to maintain this double helix shape created by counter-clock wise helix strand 36.

FIG. 14 shows an alternate manner of using counter clockwise helix strand 36 by using right hand helix 38 and left hand helix 40 creating a pattern that mimics the Koch Snowflake with golden mean scaling where left hand helix 40 is staggered from right hand helix 38 by half module 42 each full module 44. The pattern starts with outer end bracing triangle 16 on the bottom and center pol 20, outer helical rod 22 and inner helical rod 24 extending upward, rotated 137.5 degrees and bent, as necessary to maintain this double helix shape created by two counter-clockwise helix stands 36.

FIG. 15 shows an outer end bracing schematic view of the improved load bearing structure. Outer end bracing triangle 16 is shown with its sides bifurcated with lines. Outer end bracing triangle 16 has a height of 4.5 Φ' where outer helical rod 22 and inner helical rod 24 can be attached where any of the lines contact a side.

FIG. 16 shows an inner end bracing schematic view of the improved load bearing structure. Inner bracing triangle 18 is shown with its vertices bifurcated. Inner bracing triangle 18 has a height of 3 Φ' where outer helical rod 22 and inner helical rod 24 can be attached where any of the vertices contact a side.

That which is claimed:

1. An improved load bearing structure, comprising, a center pole proximate an inner helical rod and an outer helical rod;

the inner helical rod further comprises an inner helical rod top and an inner helical rod bottom; the outer helical rod further comprises an outer helical rod top and an outer helical rod bottom;

the center pole is mechanically coupled to the outer helical rod by a plurality of cross helical support rods;

the outer helical rod is mechanically coupled to inner bracing triangle the center pole, the inner helical rod and the outer helical rod are mechanically coupled to an upper outer end bracing cross support rod and a lower outer end bracing cross support rod;

the upper outer end bracing cross support rod is mechanically coupled to upper outer end bracing triangle; the lower outer end bracing cross support rod is mechanically coupled to lower outer end bracing triangle;

such that the upper outer end bracing triangle, lower outer end bracing triangle and inner bracing triangle can have vertices bifurcated with lines to which the inner helical rod and the outer helical rod are attached in order to give the improved load bearing structure a shape of a helix based on the prime Koch Snowflake with golden mean scaling such that the improved load bearing structure is substantially stronger than structures made of material of similar type and quantity.

2. The improved load bearing structure of claim 1, the helix based on the Koch Snowflake with the golden mean scaling further comprises right hand helix and a left hand helix for greater support and durability.

3. The improved load bearing structure of claim 1, the improved load bearing structure is an arch where the relationship between a height of centerline of the arch along a ground line is 1:ϕ.

* * * * *